US005931094A

United States Patent [19]

Davidson

[11] Patent Number: 5,931,094

[45] Date of Patent: Aug. 3, 1999

[54] WEB PRESS TWIST REGISTRATION CORRECTION

[76] Inventor: Lynn E. Davidson, 1503 I1a Dr., Orange, Calif. 92665

[21] Appl. No.: 08/959,568

[22] Filed: Oct. 28, 1997

[51] Int. Cl.[6] ..... B41F 5/16

[52] U.S. Cl. ..... 101/248; 101/181

[58] Field of Search ..... 101/248, 286, 101/181

[56] References Cited

U.S. PATENT DOCUMENTS 2,975,706 3/1961 Moser et al. ..... 101/248

4,491,071 1/1985 Simeth ..... 101/248

5,778,778 7/1998 Chiloff ..... 101/181

*Primary Examiner*—Edgar Burr

*Assistant Examiner*—Amanda B. Sandusky

[57] ABSTRACT

A twist registration machine for use in adjusting twist registration in printing presses of the type that comprise a plurality of aligned print towers mounted on a support, the twist registration machine and a method for adjusting twist registration of printing images on such printing presses during printing are disclosed.

6 Claims, 1 Drawing Sheet

WEB PRESS TWIST REGISTRATION CORRECTION

FIELD OF THE INVENTION

This invention relates to web printing presses and more specifically to multiple color lithographic and offset web presses and other small specialty web presses.

BACKGROUND OF THE INVENTION

The invention is described in reference to color lithographic web presses but the method and apparatus may be used in aligning other types of web presses.

Two, three or four color posters, magazines, brochures and the like are commonly printed on a continuous web of paper that passes successively through a series of printer towers which, respectively, apply an image of one color. In order to print tonal variations and avoid overlapping color images on the paper, the print cylinders and image bearing plates must be in exact registry. Further adjustment may be required during the run as a result of wear on cylinders or image bearing plates or a change in paper characteristics which may result in wander and poor registration. Obtaining proper registration, however, is often a tedious and time consuming effort. In erecting the web press, the print towers are aligned and the spacing adjustment, and many web presses allow for longitudinal and lateral adjustment; however, many web presses have no mechanism for precision twist adjustment. The expense of press down time, in lost productivity, and the cost of keeping a press crew on the job during press set up is substantial. These expenses may make the difference between a profitable operation and a losing operation in a small print shop.

If a run requires a change of paper input roll, the registration process may have to be repeated and sometimes a change in paper characteristics requires registration adjustment during a run.

Most multi-color lithographic web presses used in specialty printing operations must be shut down to adjust orientation or twist adjustment. Due to frequent occurrence of erosion and errors in film stripping, plate making, plate bending and plate casting, variations in twist or orientation registration occur which, especially, in older machines results in interruptions in a run with production loss and time costs. Correcting twist errors is ultimately a trial and error process. Skilled pressmen may sometimes obtain correct registration on the first try; however, even the most skilled pressmen sometimes have to stop the press several times and make adjustments before proper registration is obtained.

While larger web presses and some newer small multicolor web presses are equipped with special mechanisms to adjust twist registration during operation, most small printing operations and many very substantial print shops still rely on web presses that cannot be adjusted while running.

It is an object of this invention to provide apparatus and a method for bringing images into registry while the web press is running. This invention is, in one sense, an improvement in web presses of the type that comprise multiple printing towers. In another sense, the invention is an apparatus and method that can be used with any web presses of the type referred to.

One of the important features of the invention is that it allows older web presses to remain competitive.

SUMMARY OF THE INVENTION

A registration machine for use in adjusting twist registration in web presses of the type that comprise a plurality of aligned print towers is one embodiment of the invention. The twist registration machine comprises a housing having a base for being mounted on the a support mechanism adjacent a print tower, micrometer adjusting means mounted on the housing having a base, said micrometer means comprising a shaft and means for moving the shaft reciprocally and means for engaging the shaft and a print tower of the web press for moving the print tower when the shaft is moved reciprocally.

In another embodiment, the invention is a method for adjusting twist registration of printing images in web presses of the type that comprise a plurality of aligned print towers mounted on a suitable support by any means, usually by a plurality of bolts. The method comprises mounting adjacent a print tower a twist registration machine that comprises a housing having a base for being mounted adjacent the print tower, micrometer adjusting means mounted on the housing having a base, the micrometer adjusting means comprising a shaft and means for moving the shaft reciprocally relative to the housing having a base, and means for engaging the shaft and a print tower of the web press for twisting the print tower when the shaft is moved reciprocally. A sleeve is placed in one of the holes through which securing bolts pass to prevent lateral or horizontal movement, allowing only pivotal movement at that hole. The bolts that secure the print tower to the support are thread locked in a snug but not locked position while the web press is running that allows the micrometer adjusting means to move the shaft reciprocally for thereby pivoting the tower relative to the web of paper being printed until the image carried by the print tower is in registration with an image carried by another print tower. Typically, an adjustment of from about 0.01 to about 0.025 inch is sufficient to bring the image into perfect registration, but adjustments of as little as 0.001 inch may be required in some instances.

DESCRIPTION OF THE PREFERRED EMBODIMENT

The invention is describe with reference to an exemplary web press of the type with which the invention may be used. The invention may be used, however, with most multiple print tower lithographic web presses in which the towers are mounted in alignment with each other and adjustable relative to each other. The specific mechanical arrangement of the invention is not critical so long as the needed function is achieved. The structures depicted are somewhat simplified to illustrate essential features and some optional features. Variations and modifications of these structures within the scope of the invention is contemplated.

Referring first to FIGS. 1–4 an exemplary prior art web press is shown. The web press comprises a plurality of print towers 10, 12, 14, and 16 mounted on a suitable support, e.g. a table 20. Paper web from roll 22 passes through the printing nip in each of the towers, and the printed web is withdrawn at the other end as indicated at 24. The towers apply, respectively, four different colors of ink to the web. The web take off mechanism, not being part of the invention, is not shown.

The exemplary web press is provided with a support 20 which may be any structure that permits the print towers to be aligned.

Figure 1:
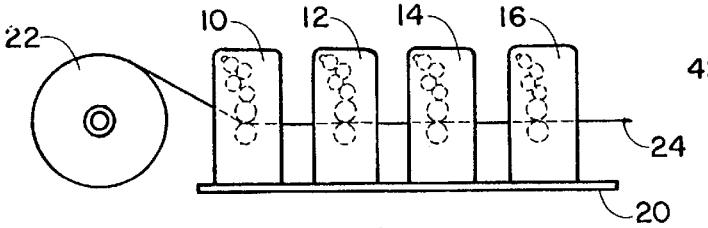
FIG. 1 PRIOR ART
FIG. 1 is a side view depicting largely schematically a prior art web press of the type to which this invention is applicable. The web press depicted is a very popular Didde web press; however, the invention is applicable to many web presses.
Figure 2:
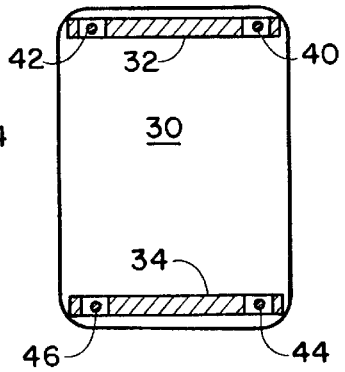
FIG. 2 PRIOR ART
FIG. 2 is a top view of the bottom plate of one of the print towers showing in cross-section portions of the vertical support frame which supports the inking rollers, print roller, etc.
Figure 3:
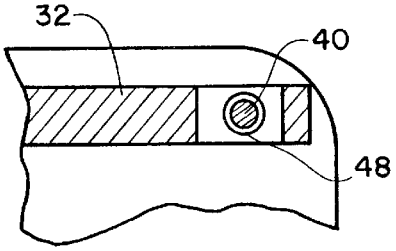
FIG. 3 is an enlarged view the pivot bolt used in this invention wherein the bolt is surrounded by a sleeve or bushing to prevent all but pivotal motion about the bolt

As shown in FIG. 2, each tower comprises a bottom plate 30 and, typically, a pair of upstanding support frame members 32 and 34. It is to be remembered that the press is shown largely schematically and is not part of the invention and that many press constructions are equivalent. The tower is secured to the support. In the exemplary embodiment, bolts 40, 42, 44 and 46 extend through passages in the bottom plate 30 of the tower. Typically, in prior art presses, the bolt is smaller than the hole through which it passes, allowing limited adjustment in all directions of the print head on the support.

While it is possible to secure the tower permanently to the support with the towers in perfect alignment and so positioned that registration is perfect using a particular web material, such an arrangement is not practicable. A different image bearing plate is installed for each printing job. While the fabrication of image bearing plates is a rather precise operation, there are, nevertheless, errors occur in the various processes required to produce and install the image bearing plates. These variations are sufficient to result in poor registration of the separate color images. It has, therefor, been necessary to make the print towers adjustable relative to each other. In general, all but the first print tower must be adjustable relative to the first print tower.

Various twisting adjustment mechanisms may be used. In the exemplary web press, the bolts 42, 44 and 46 extend through holes in the bottom plate 30 that are larger than the bolt. The bolt 40, however, extends through a bushing 48, best shown in FIG. 3, snugly receives the bolt, thus permitting only pivotal movement of the print tower on bolt 40. While pivotal movement is permitted, the print tower cannot be moved laterally or longitudinally on the support, thus maintaining alignment of the tower on the support and spacing from the adjacent print towers.

Figure 4:
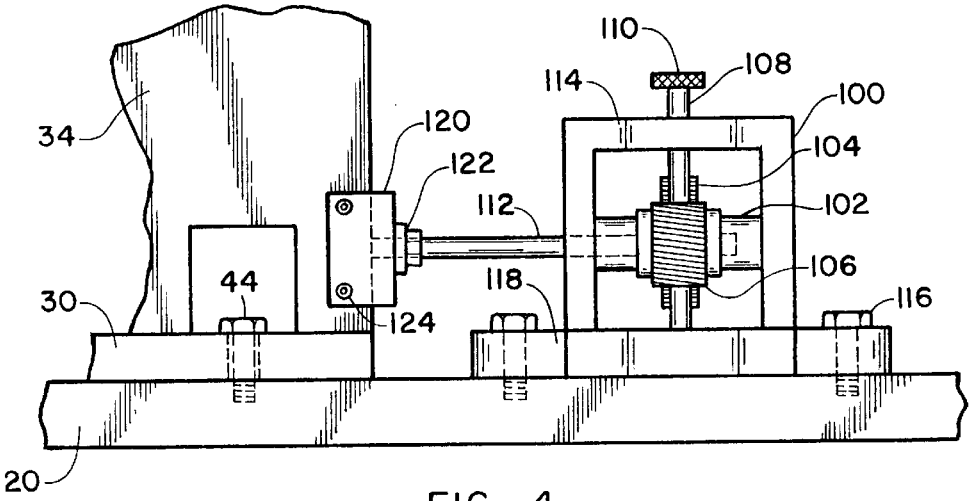
FIG. 4 depicts the micrometer adjusting mechanism of this invention to one corner of a print tower.
Figure 5:
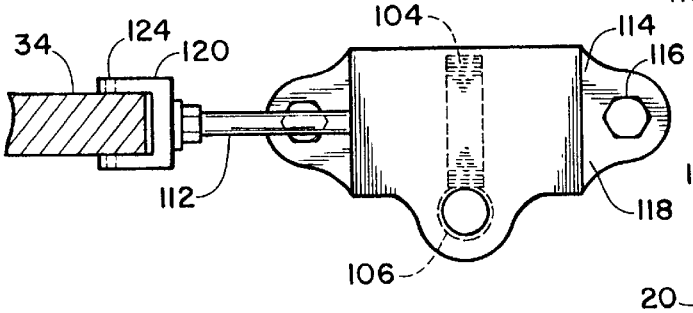
FIG. 5 is a top plan view of the mechanism of this invention.
Figure 6:
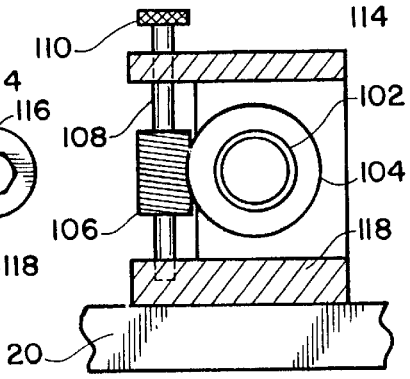
FIG. 6 is an end view in partial cross-section showing the screw adjusting mechanism of this invention.

The twist registration adjusting machine of this invention 100 comprises three major components, shown in FIGS. 4, 5 and 6, namely, a micrometer 102, a housing 114 having a base 118 that includes a base for being mounted on the support 20 and a clamp 120. The micrometer 102 may be any of many kinds of micrometers. Ultra fine adjustment is accomplished by mounting the micrometer to minimize errors arising from couplings and thread reversal, and by the utilization of a worm gear arrangement comprising a micrometer drive gear 104 surrounding and driving the micrometer and a worm drive gear 106 for driving the micrometer drive gear. As best shown in FIGS. 4 and 6, the worm drive gear is mounted on a shaft 108 that is turned by a knob or handle 110. The micrometer drives shaft 112 to the right or left, depending on the direction the worm gear is turned. Adjustments can accurately be made to 0.0001 inch, although such accuracy is not always required. The entire micrometer assembly is carried in a housing 114 which, as shown in FIGS. 4, 5 and 6, is generally in the form of a polyhedron with an extension for carrying the worm drive and with flanges to permit the attachment of the mechanism to the print tower frame member 34 by any convenient means.

The shaft 112 is secured to a clamp 120 which may be of most any configuration that will be securable to a print head. The shaft 112 is threaded into the clamp and may be locked in place with a lock washer and nut 122. The clamp is, in this example, secured to the print head by one or more allen set screws, one exemplary allen set screws being indicated at 124. Any type of secure fastener may, however, be used.

Securement of the micrometer mechanism to the support may be accomplished using bolts, set screws, clamps, or any other suitable means. Securement may be permanent or temporary.

A micrometer, as the term is used here, refers to any instrument for measuring and/or setting very small distances, e.g. in the range of 0.0001 to 0.001 inch. Preferred micrometers are those that comprise a very finely threaded screw of definite pitch which carries a shaft and is operated by a cylindrical nut on the screw such that when the nut is turned the shaft moves reciprocally very small distances. A simple micrometer such as a finely threaded screw threadably received in the housing having a base may, however, be used if the end is mounted to the clamp on the print tower.

In use, the micrometer mechanism acts as a twist registration tool which is by moving the corner of the print tower forward or backward, i.e., right or left as shown in FIG. 4. The press operator can, by checking the twist registration of the final printed copy, determine which optimum registration is obtained. The amount of movement of the print tower accomplished by the twist registration tool is very small but is sufficient to compensate for any variations that arise from the manufacture of the print cylinders and image bearing plate. Presses of the type under consideration fix lateral registration or permit lateral registration of the cylinders and image bearing plates; accordingly, only very minor changes are required to correct for variations in the surface of the print cylinders.

As pointed out, the twist registration tool of this invention comprises, in combination, a housing having a base configured and constructed for being secured at a fixed position on the support that supports the print tower, means on the housing having a base for moving a shaft precisely predetermined distances relative to the housing having a base and means for securing the end of the shaft to the print tower.

In the exemplary embodiment, the knob, shown as knurled is rotated while the web press is running thereby moving the shaft forward or backward relative to the web being printed, right or left thereby pivoting the print tower, which is permitted slight pivotal movement under the heads of the thread locked bolts that secure it to the support. The twist registration machine may be operated until, as determined by checking the final printed copy, perfect or optimum registration is obtained. Once registration is obtained, the bolts holding the press tower to the support are tightened and the run of printing is continued. Usually, no further adjustment is required; however, further twist registration adjustment can be made during the run in the same manner if needed. Additional adjustments may result from wear on the printing plate, a change in paper, etc.

To summarize, the invention is embodied in a twist registration adjusting machine 100 for use in adjusting twist registration in printing presses of the type that comprise a plurality of aligned print towers 30, 32, and 34 mounted on a support 20. It should be understood that the support (20) is not part of the print towers and is not part of the invention. It is simply a support. As stated previously in the specification, it may be a table, but any support that will support the print towers and the twist registration machine will be satisfactory. The twist registration machine comprises a housing 114 that includes a base 118 for being mounted on the support 20. It should be understood that the support 20 is not part of the twist registration machine. It simply supports the twist registration machine. A micrometer adjusting means 102 is mounted on the housing 114 that includes a base 118, said micrometer means comprising a shaft 112 and means 104, 106, 108, and 110 for moving the shaft 112 reciprocally. Means 120, 122, and 124 are provided for engaging the shaft 112 and a print tower 10, 12, 14 and 16 of the press for moving the print tower 30, 32, and 34 when the shaft 112 is moved reciprocally. The means 120, 122, and 124 are used to attach the shaft to a support element, e.g. element 34, of the print tower. It should be understood that the print tower support element 34 is not the print tower, but it is part of the print tower; consequently, attachment to the print tower support element 34 is attachment to the print tower.

The housing 114 that includes a base 118 may comprise means for mounting the micrometer adjusting means with the shaft thereof extending beyond the end of the block and the means for engaging the shaft and a print tower is a block secured to the shaft comprising means for securing the block to the print tower. As will be clear from an examination of the drawings, the base 118 is not the support 20 and is not part of the support 20. Nor is the support 20 part of the base. As shown and stated, the base 118 and the support 20 are entirely different elements. The micrometer may comprise a worm gear and a micrometer drive gear driven by the worm gear.

In another embodiment the invention is a method for correcting twist registration errors in printing on web presses of the type that comprise a plurality of aligned print towers 10, 12, 14 and 16 mounted on a support 20 by a plurality of bolts 40, 42, 44, and 46 extending through holes. The method comprises the steps of providing pivotal securing means 40, 42, 44, 46, and 48 including one of the mounting bolts for permitting only pivotal movement of a tower relative of said bolt, mounting to the support 20 adjacent a print tows 10, 20, 14 and 16 and 34 a twist registration adjusting machine 100 that comprises a housing 114 that includes a base 118 for being mounted on the support 20, micrometer adjusting means 102 mounted on the housing 114 that includes a base 118, the micrometer adjusting means 102 comprising a shaft 112 and means 104, 106, 108, and 110 for moving the shaft reciprocally relative to the housing 114 that includes a base 118 and means 120, 122, and 124 for engaging the shaft 112 and a print tower 30, 32, 34 of the press for pivoting the print tower 30, 32, and 34 about said pivotal securing means 40, 42, 44, 46, and 48 when the shaft 112 is moved reciprocally, operating the micrometer adjusting means 102 to move the shaft 112 reciprocally for thereby moving the print tower 30, 32, 34, and tightening the bolts 40, 42, 44, and 46 mounting the print tower 30, 32, and 34 to the support 20.

The invention is also embodied in a method for adjusting twist registration of printing images in printing presses of the type that print on a web of paper and that comprise a plurality of aligned print towers 10, 12, 14 and 16 mounted on a support 20 by a plurality of bolts 40, 42, 44, and 46, that comprises the steps of mounting to the support 20 adjacent a print tower 30, 32, and 34 a twist registration machine 100 that comprises a housing 114 that includes a base 118 for being mounted on the support 20, micrometer adjusting means 102 mounted on the housing 114 that includes a base 118, the micrometer adjusting means 102 comprising a shaft 112 and means 104, 106, 108, and 110 for moving the shaft 112 reciprocally relative to the housing 114 that includes a base 118 and means 120, 122, and 124 for engaging the shaft 112 and a print tower 30, 32, and 34 of the press for moving the print tower when the shaft 112 is moved reciprocally, loosening bolts 40, 42, 44, and 46 that secure the print tower 30, 32, 34 to the support 20 while the press is running, operating the micrometer adjusting means 102 to move the shaft 112 reciprocally for thereby moving the print tower 30, 32, 34 relative to the web of paper being printed until the image carried by the print tower is in registration with an image carried by another print tower, and tightening the bolts 40, 42, 44, and 46 mounting the print tower to the support 20.

To further summarize what is clearly disclosed in the specification and the drawings. There are three major structures: First, there is the support 20 which may be of any kind. The support is not part of the structures referred to hereinafter. Second, there is the print head or print frame. The print head or print frame includes as part thereof print frame support members 32 and 34 and a bottom plate 30. The support 20 is not part of the print head or print frame, nor is the bottom plate part of the support. Third, there is the twist registration adjusting means. The twist registration adjusting means includes a base 118 that is part of a housing 114 that is secured to the support 20 but the twist registration adjusting means it is not part of the support nor is the support part of the twist registration means. The twist registration adjusting means is attached to one of the print frame support members 32 and 34, but it is not part of the print frame support member nor is the print frame support member part of the twist registration adjusting means.

The invention is, of course, not limited to the specific exemplary embodiment. The twist registration machine must comprise the major components fabricated or assembled for performing the function as described; however, the specifics of any or all of the components is subject to choice and considerable variations are within the scope of the invention.

INDUSTRIAL APPLICATION

This invention is useful in the printing industry.

What is claimed is:

1. A twist registration adjusting machine (100) for use in adjusting twist registration in printing presses of the type that comprise a plurality of aligned print towers (10, 12, 14 and 16) mounted on a support (20), the twist registration machine comprising: housing (114) that includes a base (118) for being mounted on the support 20; micrometer adjusting means (102) mounted on the housing (114) that includes a base (118), said micrometer means comprising a shaft (112) and means (104, 106, 108, 110) for moving the shaft (112) reciprocally; and means (120, 122, 124) for engaging the shaft (112) and a print tower (30, 32, 34) of the press for moving the print tower (30, 32, 34) when the shaft (112) is moved reciprocally.

2. The twist registration adjusting machine of claim 1 wherein the housing (114) that includes a base (118) is a block comprising means for mounting the micrometer adjusting means with the shaft (112) thereof extending beyond the end of the block and wherein the means (120, 122, 124) for engaging the shaft and a print tower is a block (120) secured to the shaft and means (122, 124) for securing the block to the print tower.

3. The twist registration adjusting machine of claim 2 wherein the micrometer comprises a worm gear (106) and a micrometer drive gear (104) driven by the worm gear.

4. A method for correcting twist registration errors in printing on web presses of the type that comprise a plurality of aligned print towers (10, 12, 14, 16) mounted on a support (20) by a plurality of bolts (40, 42, 44, 46) extending through holes, the method comprising the steps of: providing pivotal securing means (40, 42, 44, 46, 48) including one of the mounting bolts for permitting only pivotal movement of a tower relative of said bolt; mounting to the support (20) adjacent a print tower (30, 32, 34) a twist registration adjusting machine (100) that comprises a housing (114) that includes a base (118) for being mounted on the support (20), micrometer adjusting means (102) mounted on the housing (114) that includes a base (118), the micrometer adjusting means (102) comprising a shaft (112) and means (104, 106, 108, 110) for moving the shaft reciprocally relative to the housing (114) that includes a base (118) and means (120, 122, 124) for engaging the shaft (112) and a print tower (30, 32, 34) of the press for pivoting the print tower (30, 32, 34) about said pivotal securing means (40, 42, 44, 46, 48) when the shaft (112) is moved reciprocally; operating the micrometer adjusting means (102) to move the shaft (112) reciprocally for thereby moving the print tower (30, 32, 34); and tightening the bolts (40, 42, 44, 46) mounting the print tower (30, 32, 34) to the support (20).

5. A method for adjusting twist registration of printing images in printing presses of the type that print on a web of paper and that comprise a plurality of aligned print towers (10, 12, 14, 16) mounted on a support (20) by a plurality of bolts (40, 42, 44, 46), the method comprising the steps of: mounting to the support (20) adjacent a print tower (30, 32, 34) a twist registration machine (100) that comprises a housing (114) that includes a base (118) for being mounted on the support (20), micrometer adjusting means (102) mounted on the housing (114) that includes a base (118), the micrometer adjusting means (102) comprising a shaft (112) and means (104, 106, 108, 110) for moving the shaft (112) reciprocally relative to the housing (114) that includes a base (118) and means (120, 122, 124) for engaging the shaft (112) and a print tower (30, 32, 34) of the press for moving the print tower when the shaft (112) is moved reciprocally; loosening bolts (40, 42, 44, 46) that secure the print tower (30, 32, 34) to the support (20) while the press is running; operating the micrometer adjusting means (102) to move the shaft (112) reciprocally for thereby moving the print tower (30, 32, 34) relative to the web of paper being printed until the image carried by the print tower is in registration with an image carried by another print tower; and tightening the bolts (40, 42, 44, 46) mounting the print tower to the support (20).

6. A machine correcting twist registration errors in printing on web presses of the type that comprise a plurality of aligned print towers (10, 12, 14, 16) mounted on a support (20) by a plurality of bolts (40, 42, 44, 46) extending through holes, comprising a housing (114) that includes a base (118) for being mounted on the support (20), micrometer adjusting means (102) mounted on the housing (114) that includes a base (118), the micrometer adjusting means (102) comprising a shaft (112) and means (104, 106, 108, 110) for moving the shaft reciprocally relative to the housing (114) that includes a base (118), said machine being constructed and configured to enable the shaft (112) to be secured to a print tower (30, 32, 34) of the press for pivoting the print tower (30, 32, 34) about said pivotal securing means (40, 42, 44, 46, 48) when the shaft (112) is moved reciprocally.

* * * * *